US012595647B2

(12) United States Patent
Marinov et al.

(10) Patent No.: US 12,595,647 B2
(45) Date of Patent: Apr. 7, 2026

(54) FLUSH VALVE

(71) Applicant: AS America, Inc., Piscataway, NJ (US)

(72) Inventors: Marin Marinov, East Brunswick, NJ (US); Ki Bok Song, Plainview, NY (US); Walter Pitsch, Washington, NJ (US)

(73) Assignee: AS America, Inc., Piscataway, NJ (US)

( * ) Notice: Subject to any disclaimer, the term of this patent is extended or adjusted under 35 U.S.C. 154(b) by 226 days.

(21) Appl. No.: 18/288,347

(22) PCT Filed: Apr. 28, 2022

(86) PCT No.: PCT/US2022/026744
§ 371 (c)(1),
(2) Date: Oct. 25, 2023

(87) PCT Pub. No.: WO2022/232401
PCT Pub. Date: Nov. 3, 2022

(65) Prior Publication Data

US 2024/0209610 A1 Jun. 27, 2024

Related U.S. Application Data

(60) Provisional application No. 63/181,850, filed on Apr. 29, 2021.

(51) Int. Cl.

| | |
|---|---|
| ***E03D 5/00*** | (2006.01) |
| ***E03D 3/06*** | (2006.01) |
| ***E03D 5/09*** | (2006.01) |
| ***E03D 5/10*** | (2006.01) |

(52) U.S. Cl.
CPC ..... *E03D 5/00* (2013.01); *E03D 3/06* (2013.01); *E03D 5/09* (2013.01); *E03D 5/105* (2013.01)

(58) Field of Classification Search
CPC ..... E03D 5/00; E03D 5/09; E03D 5/105
See application file for complete search history.

(56) References Cited

U.S. PATENT DOCUMENTS

| | | | | |
|---|---|---|---|---|
| 6,000,674 | A | 12/1999 | Cheng | |
| 8,556,228 | B2 * | 10/2013 | Marcichow | E03D 3/02 251/30.02 |
| 9,169,626 | B2 * | 10/2015 | Guler | E03D 5/105 |
| 10,017,931 | B2 * | 7/2018 | Boodaghians | F16K 11/074 |
| 10,578,228 | B2 * | 3/2020 | Block | F16K 37/0058 |
| 2004/0164261 | A1 | 8/2004 | Parsons et al. | |
| 2006/0143822 | A1 | 7/2006 | Kelly | |

OTHER PUBLICATIONS

PCT/US2022/026744 International Search Report dated Jul. 29, 2022.

* cited by examiner

*Primary Examiner* — Janie M Loeppke
(74) *Attorney, Agent, or Firm* — Tyler A. Stevenson; Anna-lisa L. Gallo

(57) ABSTRACT

A flush valve apparatus comprising a housing and a flush valve assembly positioned within the housing, wherein the flush valve assembly is configured to independently perform an automatic flush cycle and a manual flush cycle, the flush valve assembly comprises a sensor, a power source, and an electrical actuator, the sensor is configured to activate the electrical actuator to initiate the automatic flush cycle, and the flush valve assembly comprises a mechanical actuator configured to initiate the manual flush cycle. An electrical actuator and a mechanical actuator may both be positioned in a manifold and arranged substantially vertically in the housing.

20 Claims, 8 Drawing Sheets

FLUSH VALVE

The disclosure generally relates to a flush valve, and, in particular, to a flush valve for a toilet or a urinal.

BACKGROUND

Modern commercial sanitaryware often include a flushometer flush valve apparatus. A flushometer may require a large water supply line to operate properly. A flushometer may employ water pressure from a source water supply line to provide a high-pressure flush.

Automatic flush valves may include a diaphragm or piston separating an upper chamber (or back-pressure chamber) from a lower chamber and a water supply. When a flush valve is in a steady state (not cycling through a flush), water pressure in an upper chamber is in equilibrium with water pressure in a lower chamber, and presses down on a diaphragm or piston in a closed position. To initiate a flush cycle in an automatic flush valve, a solenoid valve is opened, allowing water to be released from an upper chamber through the main flush valve. This results in a drop in water pressure in an upper chamber, causing a diaphragm or piston to lift, creating an opening to a main water supply, allowing water from a main water supply to flow through the main valve to a sanitaryware bowl to flush the bowl. To end a flush cycle, the solenoid valve is closed, an upper chamber is refilled with water through a small hole in a diaphragm or piston, and the diaphragm or piston returns to a closed rest position, shutting off the water supply to the sanitaryware.

Desired are flush valve assemblies for toilets and/or urinals configured to perform both an automatic flush cycle and a manual flush cycle. A manual flush cycle may be desired if a power source is temporarily unavailable.

SUMMARY

Accordingly, disclosed is a flush valve apparatus comprising a housing and a flush valve assembly positioned within the housing, wherein the flush valve assembly is configured to independently perform an automatic flush cycle and a manual flush cycle, the flush valve assembly comprises a sensor, a power source, and an electrical actuator, the sensor is configured to activate the electrical actuator to initiate the automatic flush cycle, and the flush valve assembly comprises a mechanical actuator configured to initiate the manual flush cycle. An electrical actuator and a mechanical actuator may both be positioned in a manifold and arranged vertically in the housing.

In some embodiments, a mechanical actuator may comprise a plunger. A plunger may be configured to be moved downward via a user pushing a button positioned on a top surface of a flush valve apparatus. In some embodiments, a flush button may extend a distance from a flush valve apparatus when in a rest position between flush cycles. In some embodiments, a flush button may be recessed within a flush valve apparatus when fully depressed.

In some embodiments, a flush valve apparatus may comprise a manifold having apertures to receive the electrical actuator and the mechanical actuator. A manifold may comprise a thermoplastic, for example a glass-filled thermoplastic or an engineering thermoplastic.

Also disclosed is a manifold comprising openings to receive an automatic electronic actuator and a mechanical actuator. A manifold may comprise channels configured to provide fluid communication between the openings and an upper chamber of a flush valve assembly. In some embodiments, a bottom underneath surface of a manifold may at least partially define a flush valve assembly upper chamber.

Also disclosed is a flange configured to be positioned about a button associated with and configured to activate a mechanical actuator. A flange may comprise a channel to wick away any moisture that may enter a housing from around the button. In some embodiments, a top surface of the flange may provide a stop for downward motion of the button.

BRIEF DESCRIPTION OF THE DRAWINGS

This disclosure is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

Figure 1A:
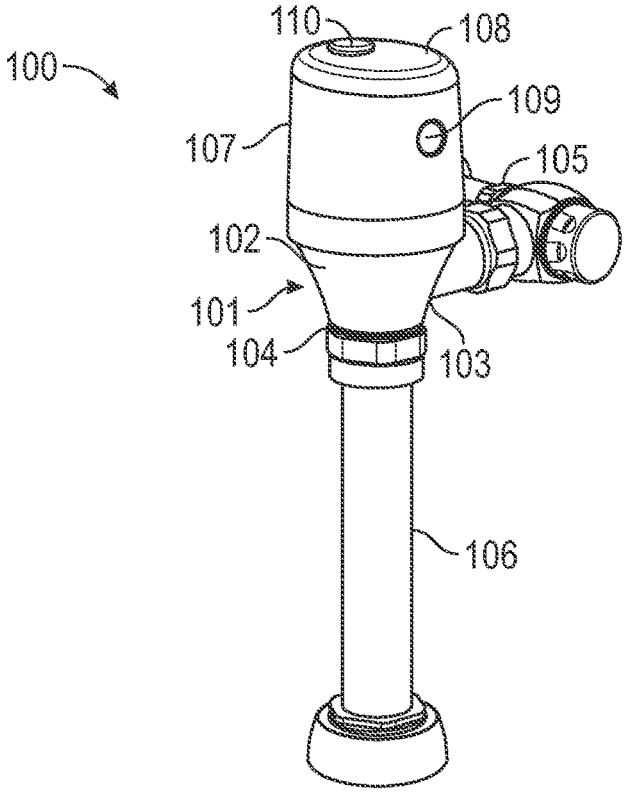
FIG. 1A and FIG. 1B show flush valve apparatuses, according to some embodiments.

FIG. 1A shows flush valve apparatus 100, according to some embodiments. Flush valve apparatus 100 may be referred to as a multi-mode flush valve apparatus. As used herein, a "multi-mode flush valve apparatus" includes a flush valve apparatus having at least (1) an automatic flush mode and (2) a manual flush mode. An automatic flush mode may utilize a sensor and a power source to initiate a flush. A manual flush mode may utilize a flush button not connected to a power source.

Flush valve apparatus 100 includes flush valve assembly 101 (not visible) disposed in lower housing 102 and valve inlet 103 and valve outlet 104. In some embodiments, lower housing 102 may comprise a metal, a plastic, or a combination thereof. In the illustrated embodiment, source water inlet pipe 105 is fluidly connected to valve inlet 103 and flush water outlet pipe 106 is fluidly connected to valve outlet 104. Source water inlet pipe 105 is configured to be fluidly connected to a building's plumbing system to provide water to a toilet. Flush water outlet pipe 106 is configured to be fluidly connected to a toilet or urinal (not shown) to provide flush water. Flush valve apparatus 100 also includes upper housing 107. In some embodiments, upper housing 107 may comprise a metal, a plastic, or a combination thereof.

Cover 108 is disposed on a top of upper housing 107. Cover 108 may have a sloped surface so that water cannot collect on cover 108. In some embodiments, cover 108 may comprise a metal, a plastic, or a combination thereof. In some embodiments, cover 108 may comprise a same material as upper housing 107. In some embodiments, cover 108 may comprise a different material than upper housing 107.

Flush valve apparatus 100 may include a power source (not visible) positioned in upper housing 107 such as, but not limited to, a battery or the like. A power source is configured to be in electrical communication with sensor 109 and an electrical actuator (not visible). Sensor 109 is positioned in upper housing 107. In some embodiments, sensor 109 is configured to detect motion, presence of an object, absence of an object, sound, temperature changes, light, electromagnetic fields, alterations in reflected energy, or any combination thereof. In some embodiments, sensor 109 may be an active infrared (IR) sensor, a capacitance detection sensor, an optical detection sensor, a thermal detection sensor, or any combination thereof. In some embodiments, sensor 109 may include a plurality of sensors. In some embodiments, sensor 109 may include a microphone to enable voice activation. It is to be appreciated that other locations for sensor 109 may be possible and are within the scope of the present disclosure. In some embodiments, sensor 109 may be directed toward a user of a toilet or urinal for which flush valve apparatus 100 is installed.

Flush valve apparatus 100 includes flush button 110 that protrudes from cover 108. Flush button 110 may be configured for a user to initiate a manual flush. As used herein, a "manual flush" may alternatively be referred to as a "mechanical flush." In a manual flush or mechanical flush, button 110 may initiate a flush by actuating flush valve apparatus 100 without using a power source and without using an electrical actuator. As such, a manual flush may also be referred to as a "power-free" flush. Flush button 110 is not electrically connected with a power source or an electrical actuator.

Figure 1B:
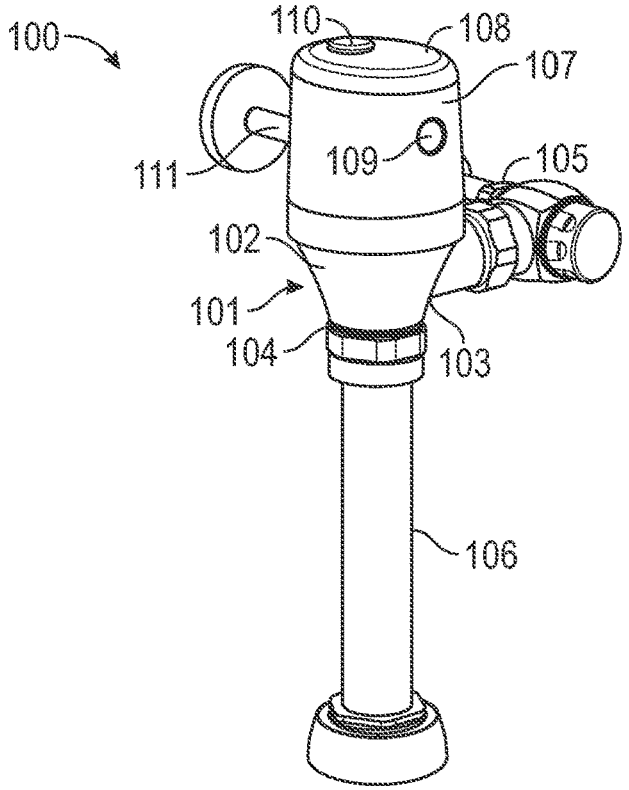

FIG. 1B shows another version of flush valve apparatus 100, according to some embodiments. FIG. 1B generally includes the same features as flush valve apparatus 100 of FIG. 1A, and further includes power conduit 111. In this embodiment, sensor 109 and an electrical actuator (not visible) may be in electrical communication with a wired power source which runs through conduit 111. A wired power source may typically be an AC main building power source. In some embodiments, flush valve apparatus 100 may be connected to an AC power source and also a backup battery. In some embodiments, flush valve apparatus 100 of FIG. 1B may be referred to as a "hardwired" installation as being wired to a building wiring.

Figure 2A:
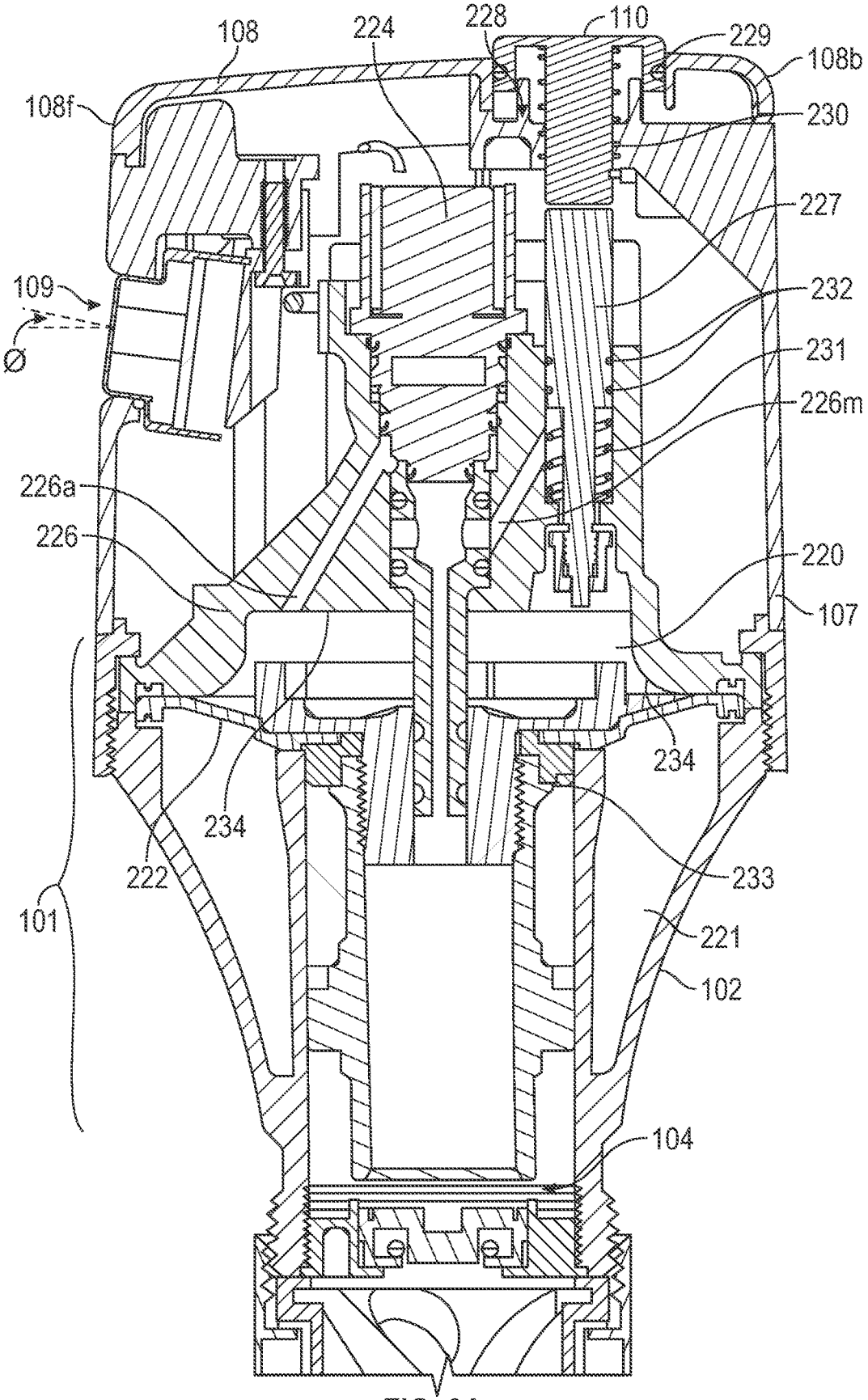
FIG. 2A and FIG. 2B show side and front sectional views of a flush valve apparatus, according to some embodiments.
Figure 2B:
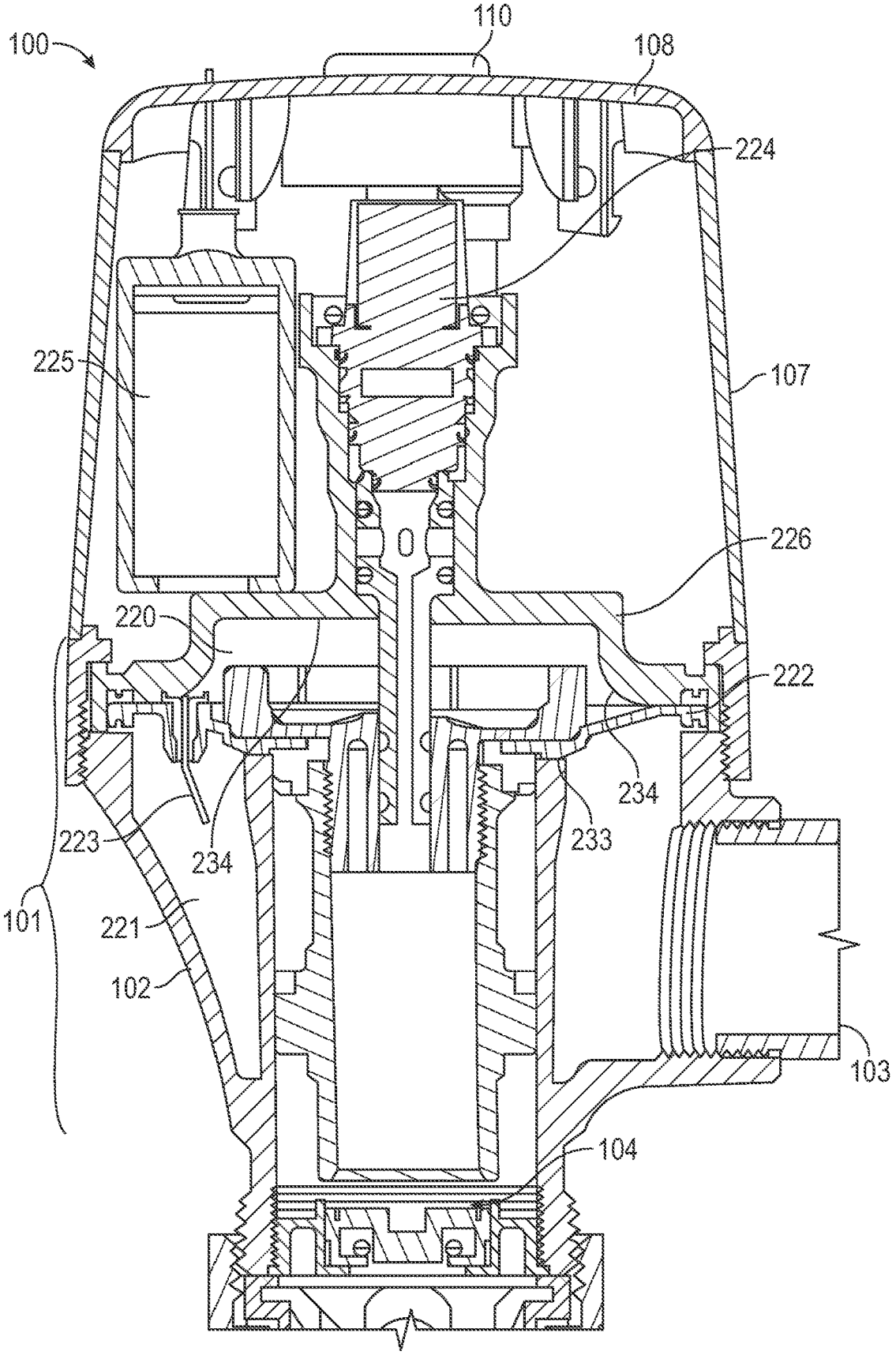

FIG. 2A and FIG. 2B show front and sectional views of a portion of flush valve apparatus 100, according to some embodiments. Visible is flush valve assembly 101 positioned in lower housing 102. Flush valve assembly 101 comprises upper chamber 220, lower chamber 221, diaphragm 222, and cleaning pin 223. Also shown are solenoid 224 (electrical actuator), battery 225, manifold 226, and plunger 227 (mechanical actuator). Upon water being released from upper chamber 220 to outlet 104, a pressure drop will cause diaphragm 222 to lift off valve seat 233, allowing source water to flow from valve inlet 103 to a toilet or urinal to perform a flush. Diaphragm 222 will re-seat to end a flush cycle when upper chamber 220 and lower chamber 221 are again in equilibrium via water passing through a small hole around pin 223. A bottom surface 234 of manifold 226 partially defines upper chamber 220.

In an embodiment, cover 108 is sloped downward from backside 108*b* to front-side 108*f*. A sloped cover 108 may serve to encourage runoff of any water that may collect on its surface. In some embodiments, cover 108 may be installed to upper housing 107 via a snap-fit. For example, cover 108 may be installed to upper housing 107 in a manner that may not require any tools (or any specialized tools) to remove it for simple maintenance such as, but not limited to, battery replacement or the like.

Manifold 226 may comprise a plastic, for example, a glass filled thermoplastic or an engineering thermoplastic. In some embodiments, manifold 226 may be prepared via injection molding or the like. A present manifold prepared via a molding process may have a more precise structure, providing highly consistent flush cycle performance. Manifold 226 is configured to provide multiple flush modes of flush valve apparatus 100 via manifold channels 226*m* and 226*a*.

Flush valve assembly 101 includes two activation modes. In an automatic mode, flush valve assembly 101 is configured to be activated by solenoid electrical actuator 224. Electrical actuator 224 is configured to be electrically connected with power source 225 and with sensor 109. Sensor 109 is configured to instruct electrical actuator 224 to initiate a flush. Sensor 109 may instruct electrical actuator 224 to initiate a flush cycle upon detecting a presence and subsequent absence of a person using a toilet or urinal. In a manual mode, flush valve assembly 101 is configured to be activated by mechanical actuator 227. Mechanical actuator 227 is configured to initiate a flush cycle when a user presses associated flush button 110.

Sensor 109 is disposed on a front side of upper housing 107. Sensor 109 may be, for example, an optical sensor and, as such, may have a sight line to a user of a toilet or urinal. In some embodiments, sensor 109 may be arranged such that a central longitudinal axis of sensor 109 is offset by an angle θ relative to a horizontal axis that is parallel to a ground surface. In some embodiments, angle θ may be from about 5° to about 10°. In some embodiments, angle θ may be from about 6° to about 9°. In some embodiments, angle θ may be from about 7° to about 8°. In some embodiments, angle θ may be about 7.5°. In some embodiments, angle θ may be selected to provide a view toward a user. In some embodiments, angle θ may be selected to minimize automatic flushing in absence of a user (e.g., due to passersby or the like).

Cover 108 includes aperture 228, which provides a location for flush button 110. Button 110 is sealed within button aperture 228 with O-ring 229. Button 110 is configured to be movable (in an up-down direction) to activate plunger 227.

In an embodiment, flush button 110 may extend upward from cover 108 as shown in FIG. 2A and FIG. 2B in a rest position, such that it may be discernable by touch or feel for one to manually initiate a flush cycle. In a depressed position, a top surface of button 110 may be substantially flush with cover 108 or below cover 108. Button 110 is configured to push on plunger 227 to initiate a manual flush. Upper spring 230 and lower spring 231 may be configured to gradually return plunger 227 and button 110 to a rest position. Plunger 227 is fitted with a pair of O-rings 232 in manifold 226.

Figure 3A:
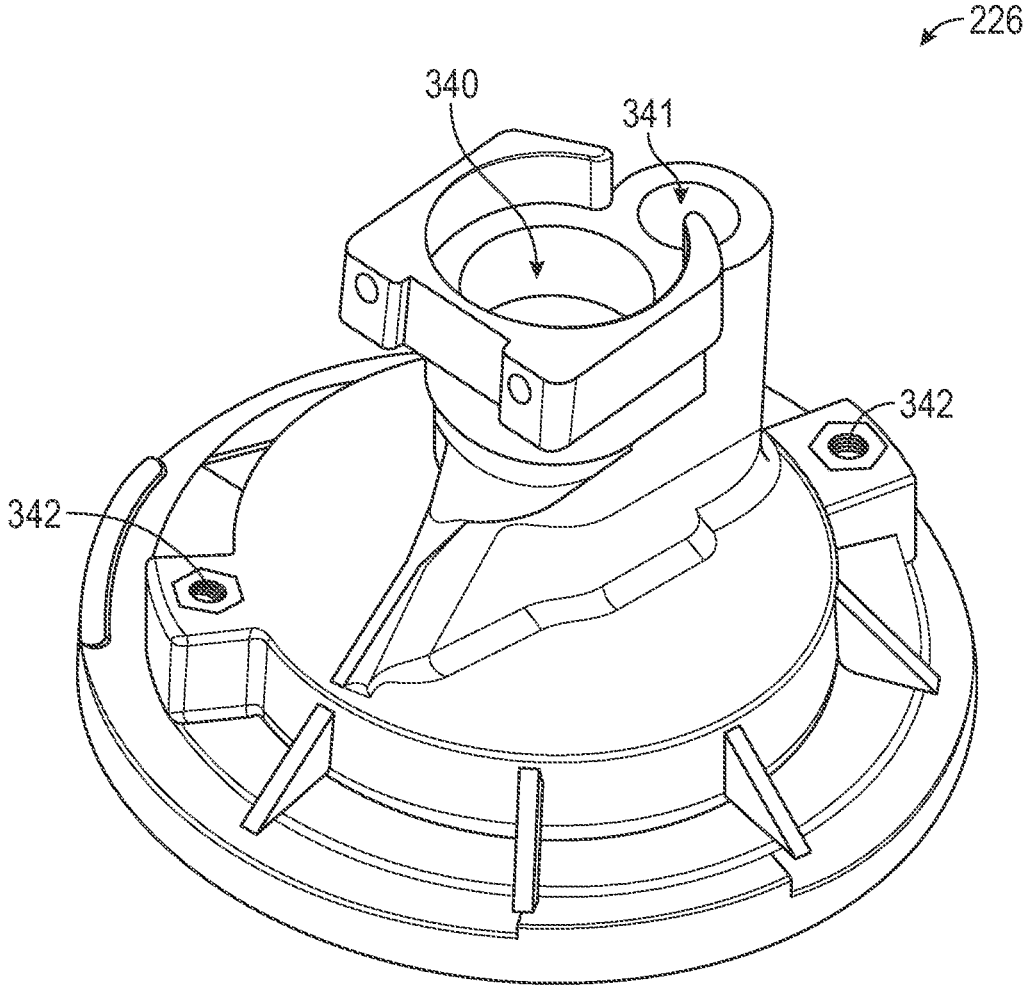
FIG. 3A and FIG. 3B provide a top view and a sectional view of a manifold, according to some embodiments.
Figure 3B:
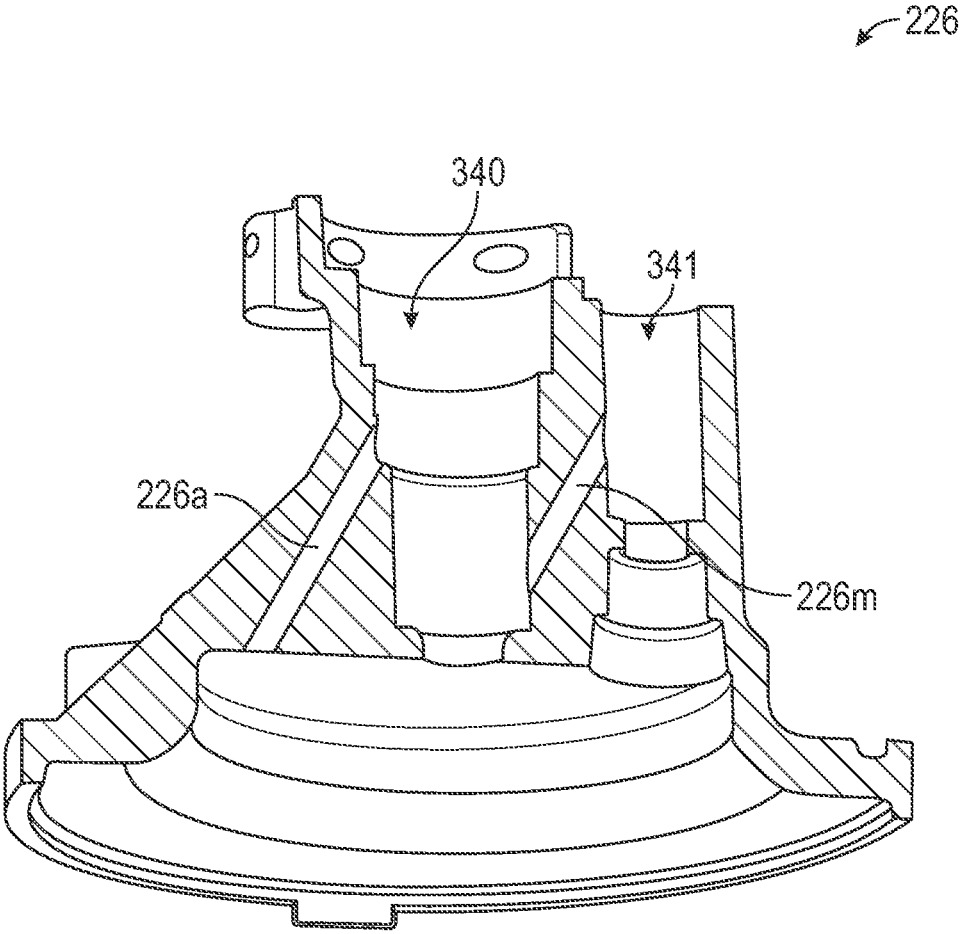

FIG. 3A and FIG. 3B show a top perspective view and a cross-section view of manifold 226, according to some embodiments. Manifold 226 includes first manifold opening 340 configured to receive electrical actuator 224 and second manifold opening 341 configured to receive mechanical actuator 227. Manifold 226 includes a plurality of fasteners 342. Fasteners 342 may be, for example, a nut or other threaded device that may be fixed into an aperture to secure manifold 226 in flush valve apparatus 100. Fasteners 342 may be configured to secure manifold 226 to lower housing 102.

Manifold 226 is configured to be positioned over upper chamber 220 of assembly 101. Upper chamber 220 is configured to be in fluid communication with manifold automatic channel 226*a* and manifold manual channel

226*m*, and with first opening 340 and second opening 341. Manifold automatic channel 226*a* is configured to be in fluid communication with upper chamber 220 and with first opening 340. Manifold manual channel 226*m* is configured to be in fluid communication with upper chamber 220, with first opening 340, and with second opening 341.

Figure 4A:
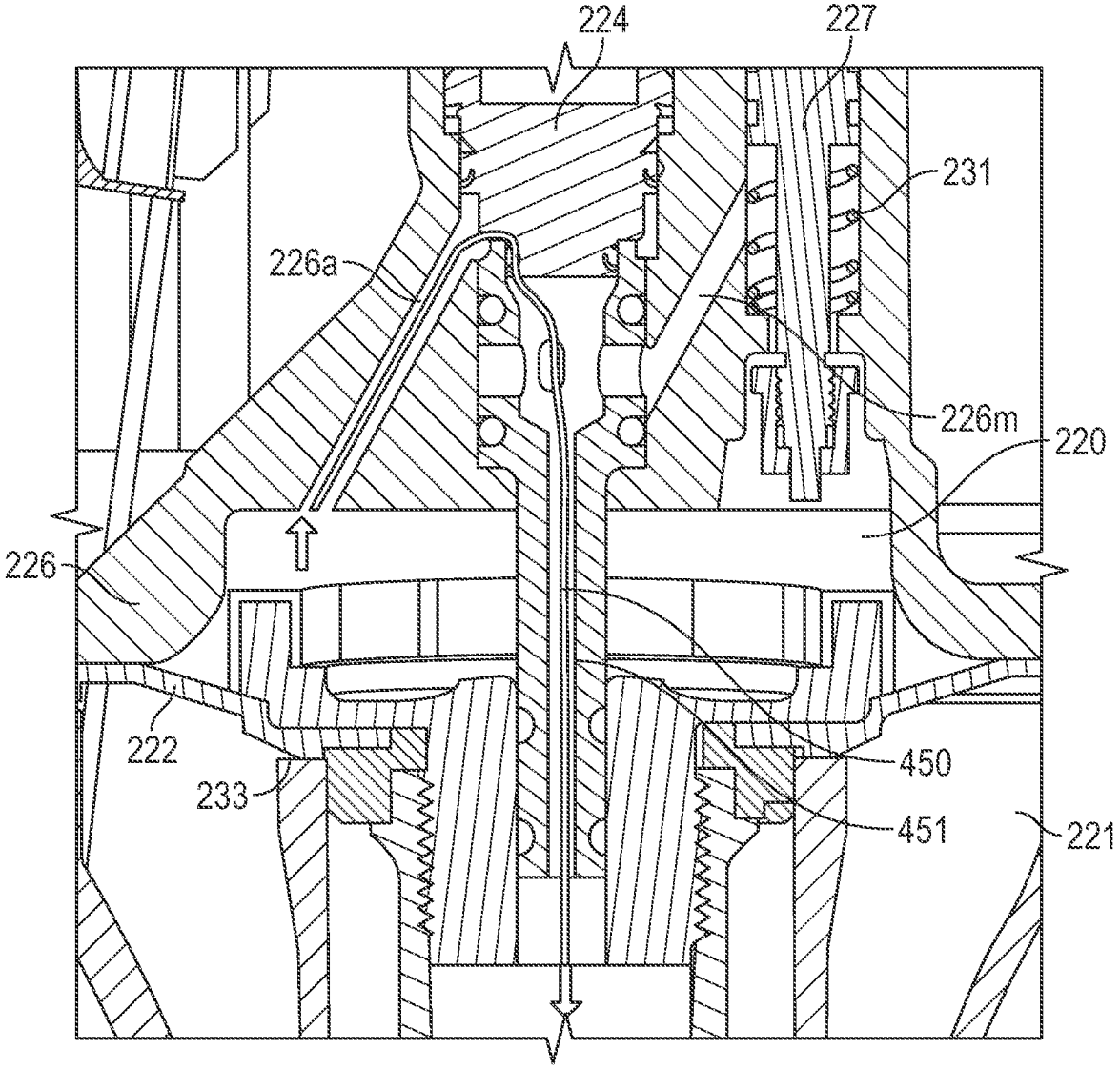
FIG. 4A and FIG. 4B show views of a portion of a flush valve apparatus, according to some embodiments.

FIG. 4A shows a water flow path in an automatic flush mode of flush valve apparatus 100, according to some embodiments. Visible are upper chamber 220 and lower chamber 221 separated by diaphragm 222. Upper chamber 220 comprises water in equilibrium with water in lower chamber 221. When an automatic flush mode is triggered by sensor 109, solenoid valve 224 opens, allowing fluid flow 450 from upper chamber 220, upward through channel 226*a*, and downward through central bore 451 to outlet 104. Water released from upper chamber 220 results in a pressure drop, causing diaphragm 222 to lift off valve seat 233, to allow flush water from a water source to pass through assembly 101 to provide a flush.

Figure 4B:
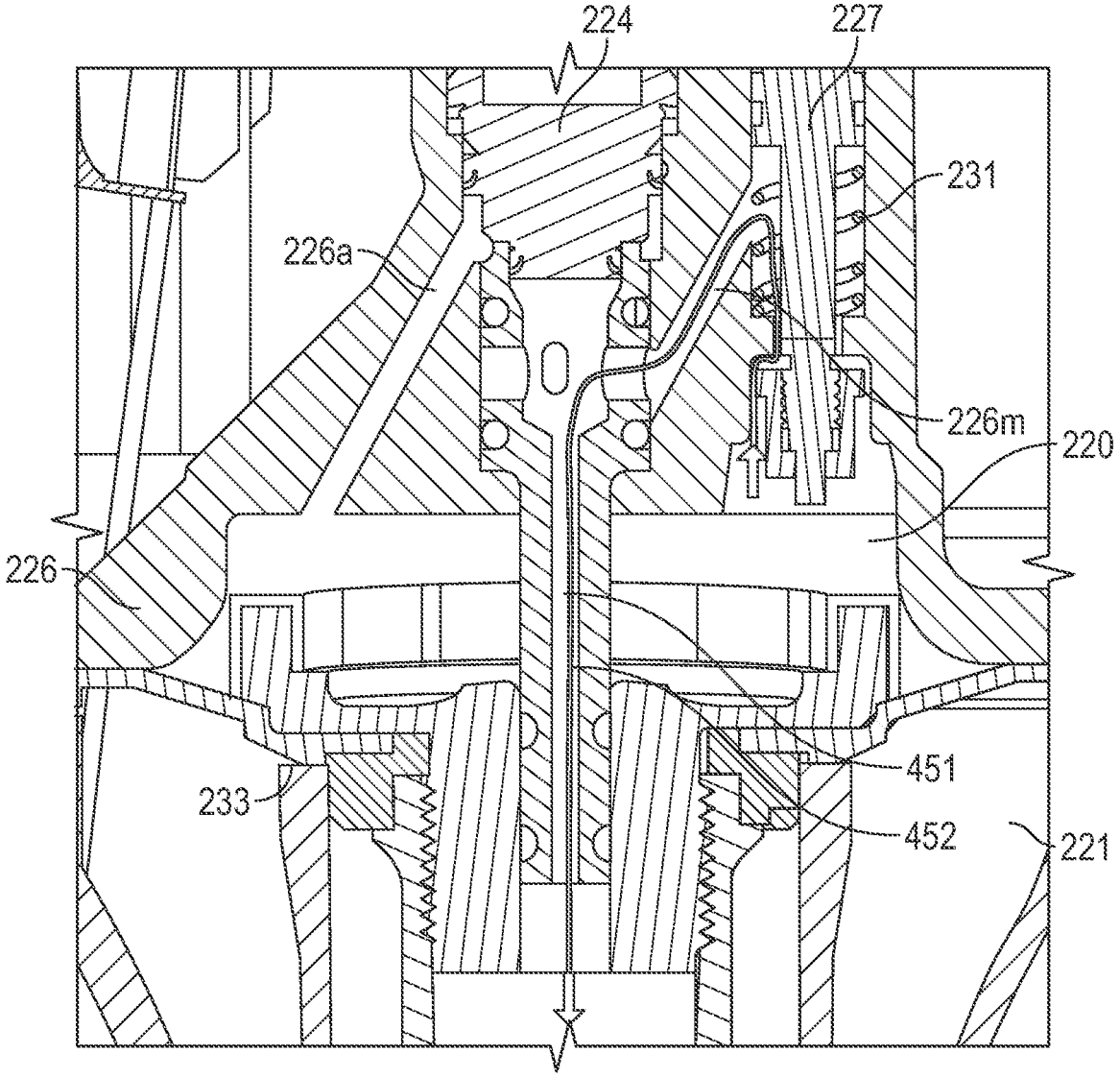

FIG. 4B shows a water flow path in a manual flush mode of flush vale apparatus 100, according to some embodiments. Visible are upper chamber 220 and lower chamber 221 separated by diaphragm 222. Upper chamber 220 comprises water in equilibrium with water in lower chamber 221. When a manual flush is initiated by a user pushing button 110 downward, plunger 227 (mechanical actuator) is moved downward, opening a path for manual fluid flow 452 from upper chamber 220, downward through channel 226*a*, and downward through central bore 451 to outlet 104. Water released from upper chamber 220 results in a pressure drop, causing diaphragm 222 to lift off valve seat 233, to allow flush water from a water source to pass through assembly 101 to provide a flush. Springs 230 and 231 may be configured to move plunger 227 back to a closed position.

Figure 5A:
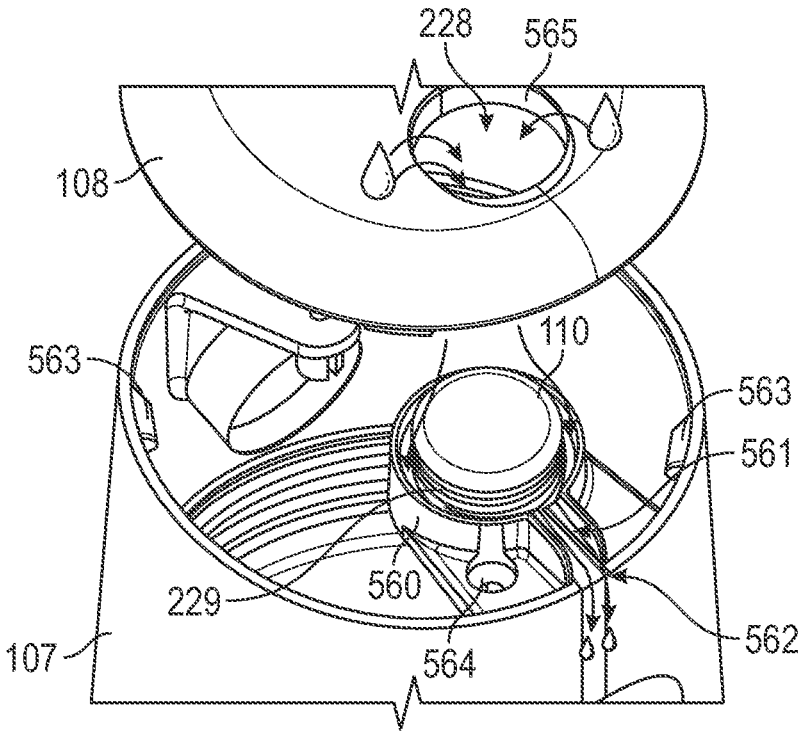
FIG. 5A and FIG. 5B show partial views of a flush valve apparatus, according to some embodiments.
Figure 5B:
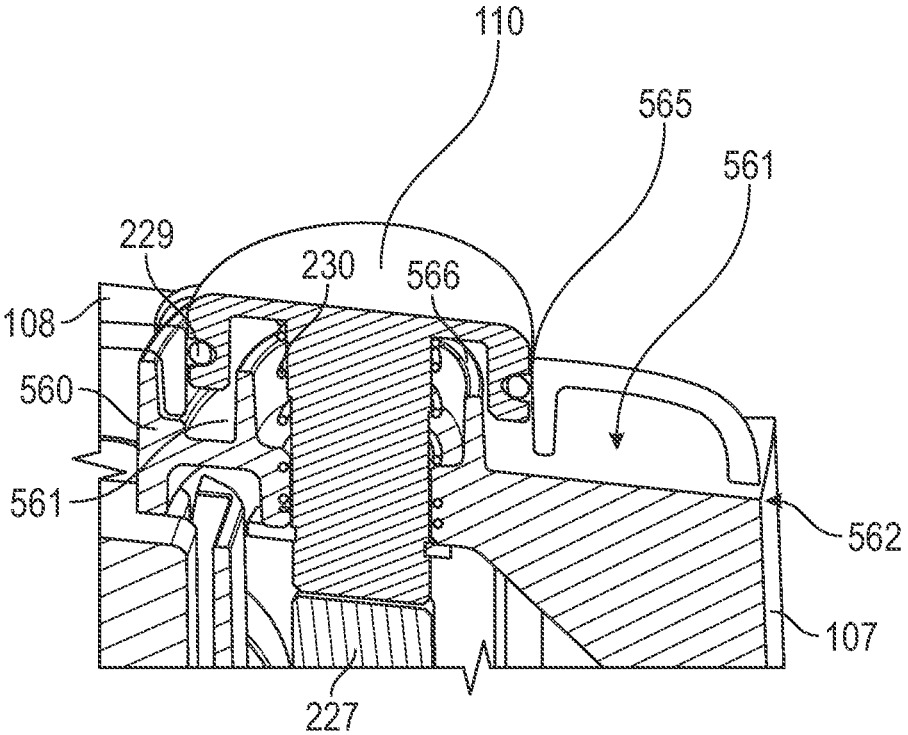

FIG. 5A provides a view of flush valve apparatus 100 with cover 108 lifted off upper housing 107, according to some embodiments. FIG. 5B provides a cross-section view of a top portion of apparatus 100, according to some embodiments. Flush button 110 is coupled to O-ring 229 to form a moveable seal with aperture 228 inner surface 565. Button 110 is surrounded by flange 560, comprising moisture flow path 561. In some embodiments, flange 560 may be integrally formed with upper housing 107. In an event that trace amounts of moisture might enter a space between an outer edge of flush button 110 and aperture inner surface 565, moisture will be diverted to moisture outlet 562, positioned between cover 108 and housing 107. Accordingly, components of flush valve assembly 101 will be protected from moisture. In the illustrated embodiment, the O-ring gasket 229 is configured to move together with flush button 110 to maintain a seal. In some embodiments, flange top surface 566 may provide a stop position for downward motion of button 110.

Tabs 563 are configured to form a snap-fit with cover 108. Cover 108 may simply be lifted off upper housing 107 to provide access to a battery (not shown). Cover 108 may comprise complimentary tabs to couple to tabs 563. Apparatus 100 may comprise a fastener 564, or 2 or more such fasteners, configured to enclose components of flush valve assembly 101, including diaphragm 222, solenoid 224, and manifold 226. Fasteners 564 may be tamper proof, and may require a specialized tool to prevent unwanted access to components of flush valve assembly 101.

Following are the numeric labels of features of the figures.

| | | |
|---|---|---|
| 100 flush valve apparatus | 101 flush valve assembly | 102 lower housing |
| 103 valve inlet | 104 valve outlet | 105 water inlet pipe |
| 106 flush water outlet pipe | 107 upper housing | 108 cover |
| 109 sensor | 110 flush button | 111 power conduit |
| 220 upper chamber | 221 lower chamber | 222 diaphragm |
| 223 cleaning pin | 224 solenoid | 225 battery |
| 226 manifold | 226a manifold channel | 226m manifold channel |
| 227 mechanical actuator | 228 button aperture | 229 O-ring |
| 230 upper spring | 231 lower spring | 232 O-rings |
| 233 valve seat | 234 manifold bottom surface | 340 first opening |
| 341 second opening | 342 fasteners | 450 automatic flow path |
| 451 central bore | 452 manual flow path | 560 flange |
| 561 moisture flow path | 562 moisture outlet | 563 tabs |
| 564 fastener | 565 aperture inner surface | 566 flange top surface |

Some embodiments of this disclosure are directed to flush valves capable of operating in different modes, including a hands-free (or automatic) mode and a mechanical (or standard or manual) mode. Multiple modes may, for example, allow a flush cycle to be initiated automatically without touching the flush valve or, alternatively, to initiate a flush by pressing a button. In some embodiments, a button for a mechanical mode is not connected to a power source for the sensor and electrical actuator.

In some embodiments, a sensor, an electrical actuator, and a power source are in electrical communication. In some embodiments, a sensor is present on a housing of the flush valve. Electrical communication may be via a wire (e.g., electric cable) connected to the sensor, the electrical actuator, and a power source. In some embodiments, a power source may be a battery, for example a rechargeable battery. In some embodiments, electrical communication may be wireless. Examples of suitable wireless communication include, but are not limited to, Wi-Fi, near field communication, Bluetooth®, ZigBee, any combination thereof, or the like.

In some embodiments, a sensor may be present on a front of a housing of a flush valve assembly. In some embodiments, a sensor may be present on a back or side of a flush valve. In some embodiments, a sensor may be separate from the housing of the flush valve.

In some embodiments, a flush valve may include one or more indicator lights configured to display a status of a battery power source. An indicator light may be configured to provide light of different colors (e.g. white, blue, green, red, orange, etc.) indicative of a battery being charged or requiring replacing or charging—or indicating that battery has a certain expected life remaining, for example 180 days, 150 days, 120 days, 90 days, 60 days, 45 days, 30 days, 15 days, 10 days, or 5 days.

In some embodiments, a flush valve assembly may be positioned on a urinal or a tankless toilet.

Following are some non-limiting embodiments of the disclosure.

In a first embodiment, disclosed is a flush valve apparatus, comprising a housing; and a flush valve assembly positioned within the housing, wherein the flush valve assembly is configured to independently perform an automatic flush cycle and a manual flush cycle, the flush valve assembly comprises a sensor, a power source, and an electrical actuator, the sensor, the power source, and the electrical actuator are in electrical communication, and the sensor is configured to activate the electrical actuator to initiate the automatic flush cycle, and the flush valve assembly comprises a mechanical actuator configured to initiate the manual flush cycle. A mechanical actuator is not electrically connected to a power source.

In a second embodiment, disclosed is a flush valve apparatus according to the first embodiment, comprising a moveable feature associated with the mechanical actuator, wherein the moveable feature is, for example a button, knob, lever, switch, and the like, and wherein the moveable feature is positioned in the housing. In an embodiment, a moveable feature and/or a mechanical actuator may be associated with a spring configured to return the moveable feature and mechanical actuator to a rest position after being manually actuated. In some embodiments, a mechanical actuator may be a plunger.

In a third embodiment, disclosed is a flush valve apparatus according to the first or second embodiments, wherein the housing comprises a cover, and for example wherein a moveable feature is positioned in the cover. A cover may be positioned over a top of a housing.

In a fourth embodiment, disclosed is a flush valve apparatus according to the third embodiment, wherein the moveable feature is associated with a flange, and wherein the flange comprises a channel configured to drain moisture out of the apparatus. In a fifth embodiment, disclosed is a flush valve apparatus according to embodiment 4, wherein the flange channel comprises an outlet positioned between the cover and the housing to drain moisture out of the apparatus. In a sixth embodiment, disclosed is a flush valve apparatus according to embodiments 4 or 5, wherein a flange upper surface is configured to provide a stop position for a downward motion of the moveable feature.

In a seventh embodiment, disclosed is a flush valve apparatus according to any of embodiments 3 to 6, wherein the cover may be snap-fit to the housing. In an eighth embodiment, disclosed is a flush valve apparatus according to any of embodiments 3 to 6, wherein the cover is sloped. In an embodiment, a cover may be removed from and replaced on a housing without any tools or without any specialized tools.

In a ninth embodiment, disclosed is a flush valve apparatus according to any of the preceding embodiments, comprising 2 or more fasteners configured to enclose the flush valve assembly.

In a tenth embodiment, disclosed is a flush valve apparatus according to any of the preceding embodiments, wherein the flush valve assembly comprises a diaphragm or a piston.

In an eleventh embodiment, disclosed is a flush valve apparatus according to any of the preceding embodiments, wherein the sensor is positioned at an upward angle relative to a horizontal ground surface.

In a twelfth embodiment, disclosed is a flush valve apparatus according to any of the preceding embodiments, wherein the flush valve assembly comprises a manifold configured to be positioned over an upper chamber of the flush valve assembly, and wherein the manifold comprises a first opening configured to receive the electrical actuator, and a second opening configured to receive the mechanical actuator. In some embodiments, a bottom surface of a manifold at least partially defines an upper chamber of a flush valve assembly.

In a thirteenth embodiment, disclosed is a flush valve apparatus according to embodiment 12, wherein the first opening and the second opening are substantially parallel and substantially vertically positioned. Substantially parallel meaning a central axis of the openings are substantially axially aligned. Substantially vertically positioned meaning a central axis is substantially perpendicular to a horizontal ground.

In a fourteenth embodiment, disclosed is a flush valve apparatus according to embodiments 12 or 13, wherein the manifold comprises a first channel configured to be in fluid communication with the first opening and the upper chamber, and a second channel configured to be in fluid communication with the second opening and the upper chamber. In an embodiment, the second channel is configured to be in fluid communication with the first opening, the second opening, and the upper chamber.

In a fifteenth embodiment, disclosed is a flush valve apparatus according to any of embodiments 12 to 14, wherein the manifold comprises a glass-filled thermoplastic or an engineering thermoplastic. Engineering thermoplastics include polyamides, polyesters, polycarbonates, polyacetals, acrylonitrile-butadiene-styrene copolymer, etc.

In a sixteenth embodiment, disclosed is a flush valve apparatus according to any of the preceding embodiments, wherein the sensor is configured to detect motion, presence of an object, absence of an object, sound, temperature changes, light, electromagnetic fields, alterations in reflected energy, or any combination thereof.

In a seventeenth embodiment, disclosed is a flush valve apparatus according to any of the preceding embodiments, wherein the sensor is an active infrared sensor, a capacitance detection sensor, an optical detection sensor, a thermal detection sensor, or any combination thereof.

In an eighteenth embodiment, disclosed is a flush valve apparatus according to any of the preceding embodiments, wherein the sensor includes a plurality of sensors. In a nineteenth embodiment, disclosed is a flush valve apparatus according to any of the preceding embodiments, wherein the sensor includes a microphone.

In a twentieth embodiment, disclosed is a flush valve apparatus according to any of the preceding embodiments, wherein the housing comprises an upper housing and a lower housing. In some embodiments, an upper housing may be threadingly coupled to a lower housing. In some embodiments, a manifold may be coupled to a lower housing. In some embodiments, a manifold may be coupled to both an upper and lower housing. An upper housing and a lower housing may comprise same or different materials, for example a metal or a thermoplastic.

In a twenty-first embodiment, disclosed is a manifold according to any of embodiments 12 to 15.

When elements are configured to receive fluid from or configured to deliver or provide fluid to another element, or when elements are coupled to other elements regarding fluid flow, the elements are in fluid communication with or fluidly coupled to each other.

The term "adjacent" may mean "near" or "close-by" or "next to".

The term "coupled" means that an element is "attached to" or "associated with" another element. Coupled may mean directly coupled or coupled through one or more other elements. An element may be coupled to an element through two or more other elements in a sequential manner or a non-sequential manner. The term "via" in reference to "via an element" may mean "through" or "by" an element. Coupled or "associated with" may also mean elements not directly or indirectly attached, but that they "go together" in that one may function together with the other.

The term "flow communication" means for example configured for liquid or gas flow there through and may be synonymous with "fluidly coupled" or "fluid communication". The terms "upstream" and "downstream" indicate a direction of gas or fluid flow, that is, gas or fluid will flow from upstream to downstream.

The term "electrical communication" may be synonymous with "electrically coupled" or "electrically connected" and may mean an element may send or receive electricity or electronic signals to another element, either via a wired connection or a wireless connection. The term "associated with" may mean "coupled", i.e. "electrically coupled".

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive.

The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

Features described in connection with one embodiment of the disclosure may be used in conjunction with other embodiments, even if not explicitly stated.

Embodiments of the disclosure include any and all parts and/or portions of the embodiments, claims, description and figures. Embodiments of the disclosure also include any and all combinations and/or sub-combinations of embodiments.

The invention claimed is:

1. A flush valve apparatus, comprising a housing;

a flush valve assembly positioned within the housing; and a manifold positioned within the housing, wherein the flush valve assembly is configured to independently perform an automatic flush cycle and a manual flush cycle, the flush valve assembly comprises a sensor, a power source, and an electrical actuator, the sensor, the power source, and the electrical actuator are in electrical communication, and the sensor is configured to activate the electrical actuator to initiate the automatic flush cycle, the flush valve assembly comprises a mechanical actuator configured to initiate the manual flush cycle, the manifold comprises a first opening to receive the electrical actuator, and a second opening to receive the mechanical actuator, the manifold is positioned over an upper chamber of the flush valve assembly, and the manifold comprises a first channel in fluid communication with the first opening and the upper chamber, and a second channel in fluid communication with the second opening and the upper chamber.

2. The flush valve apparatus according to claim 1, wherein the housing comprises a cover, and a button positioned in the cover and associated with the mechanical actuator.

3. The flush valve apparatus according to claim 2, wherein the button is associated with a flange, and wherein the flange comprises a channel configured to drain moisture out of the flush valve apparatus.

4. The flush valve apparatus according to claim 2, wherein the cover is sloped.

5. The flush valve apparatus according to claim 3, wherein a flange upper surface is configured to provide a stop position for a downward motion of the button.

6. The flush valve apparatus according to claim 1, wherein the flush valve assembly comprises a diaphragm.

7. The flush valve apparatus according to claim 1, wherein the sensor is positioned at an upward angle relative to a horizontal ground surface.

8. The flush valve apparatus according to claim 1, wherein a bottom surface of the manifold partially defines the flush valve assembly upper chamber.

9. The flush valve apparatus according to claim 1, wherein a central axis of the first opening is substantially parallel with a central axis of the second opening, and wherein the first opening and the second opening are substantially vertically positioned.

10. The flush valve apparatus according to claim 1, wherein the manifold comprises a glass-filled thermoplastic or an engineering thermoplastic.

11. A flush valve apparatus, comprising a housing;

a flush valve assembly positioned within the housing; and a manifold positioned within the housing, wherein the flush valve assembly is configured to independently perform an automatic flush cycle and a manual flush cycle, the flush valve assembly comprises a sensor, a power source, and an electrical actuator, the sensor, the power source, and the electrical actuator are in electrical communication, and the sensor is configured to activate the electrical actuator to initiate the automatic flush cycle, the flush valve assembly comprises a mechanical actuator configured to initiate the manual flush cycle, the manifold comprises a first opening to receive the electrical actuator, and a second opening to receive the mechanical actuator, the manifold is positioned over an upper chamber of the flush valve assembly, and a central axis of the first opening is substantially parallel with a central axis of the second opening, the first opening and the second opening being substantially vertically positioned.

12. The flush valve apparatus according to claim 11, wherein the housing comprises a cover, and a button positioned in the cover and associated with the mechanical actuator.

13. The flush valve apparatus according to claim 12, wherein the button is associated with a flange, and wherein the flange comprises a channel configured to drain moisture out of the flush valve apparatus.

14. The flush valve apparatus according to claim 12, wherein the cover is sloped.

15. The flush valve apparatus according to claim 13, wherein a flange upper surface is configured to provide a stop position for a downward motion of the button.

16. The flush valve apparatus according to claim 11, wherein the flush valve assembly comprises a diaphragm.

17. The flush valve apparatus according to claim 11, wherein the sensor is positioned at an upward angle relative to a horizontal ground surface.

18. The flush valve apparatus according to claim 11, wherein a bottom surface of the manifold partially defines the flush valve assembly upper chamber.

19. The flush valve apparatus according to claim 11, wherein the manifold comprises a first channel configured to be in fluid communication with the first opening and the upper chamber, and a second channel configured to be in fluid communication with the second opening and the upper chamber.

20. The flush valve apparatus according to claim 11, wherein the manifold comprises a glass-filled thermoplastic or an engineering thermoplastic.

* * * * *